US008057275B2

(12) United States Patent
Cameron et al.

(10) Patent No.: US 8,057,275 B2
(45) Date of Patent: Nov. 15, 2011

(54) TOY WITH PIVOTING PORTIONS CAPABLE OF ROLLING OVER AND METHODS THEREOF

(75) Inventors: Don Cameron, Riverside, RI (US); Richard J. Maddocks, Barrington, RI (US); Jeffrey Olson, West Warwick, RI (US); Linas Peckus, Evanston, IL (US); Brian S. Kujawski, Crown Point, IN (US); Lc Yang, Guang Dong Province (CN); Zhi Xin Sun, Guang Dong Province (CN)

(73) Assignee: Hasbro, Inc., Pawtucket, RI (US)

( * ) Notice: Subject to any disclaimer, the term of this patent is extended or adjusted under 35 U.S.C. 154(b) by 418 days.

(21) Appl. No.: 12/236,336

(22) Filed: Sep. 23, 2008

(65) Prior Publication Data

US 2010/0075570 A1 Mar. 25, 2010

(51) Int. Cl.
*A63H 3/20* (2006.01)
*A63H 11/00* (2006.01)
*A63H 13/00* (2006.01)

(52) U.S. Cl. ..... 446/330; 446/375; 446/376; 446/373; 446/353; 446/384; 74/53

(58) Field of Classification Search ..... 446/371, 446/376, 373, 375, 370, 353, 330, 384, 390, 446/391, 487, 383; 472/134, 135; 74/606 R, 74/53, 54, 55, 56, 57, 58, 59; *A63H 3/20, A63H 11/00, 31/00*
See application file for complete search history.

(56) References Cited

U.S. PATENT DOCUMENTS

| | | | | |
|---|---|---|---|---|
| 1,345,052 | A | 6/1920 | Williams | |
| 1,601,983 | A | 10/1926 | Savage | |
| 1,782,477 | A | 11/1930 | Price | |
| 2,641,865 | A | 6/1953 | Gowland | |
| 3,164,924 | A | 1/1965 | Iwaya et al. | |
| 3,199,248 | A | 8/1965 | Suzuki | |
| 3,443,338 | A | 5/1969 | Collins | |
| 3,911,613 | A | 10/1975 | Morrison et al. | |
| 4,073,088 | A * | 2/1978 | Beny et al. | 446/354 |
| 4,419,841 | A * | 12/1983 | Huang | 446/353 |
| 4,878,875 | A | 11/1989 | Pin-Hung et al. | |
| 4,913,676 | A * | 4/1990 | Koguchi et al. | 446/300 |

(Continued)

FOREIGN PATENT DOCUMENTS

JP 2006326055 A * 12/2006

*Primary Examiner* — Gene Kim
*Assistant Examiner* — Matthew B Stanczak
(74) *Attorney, Agent, or Firm* — Perry Hoffman

(57) ABSTRACT

A toy employing a simple yet unique pivoting mechanism to provide back and forth and side to side pivoting movements and operable to wiggle, twist back and forth, and roll the toy over numerous times imitating a playing, cuddling and rolling over puppy or the like. The toy includes a body portion, a first pivoting portion, and a first linkage coupling the body portion to the first pivoting portion at an angled pivot point offset from a vertical axis intersecting the point at which the body and the first pivoting portions are coupled. An angled surface is included at the first pivoting portion and a gear mechanism is coupled to the body portion and operable to pivot the first pivoting portion with respect to the body portion driving the pivoting action at the angled surface of the first pivoting portion providing back and forth and side to side pivoting movements.

13 Claims, 9 Drawing Sheets

U.S. PATENT DOCUMENTS

| | | | | |
|---|---|---|---|---|
| 5,094,645 | A * | 3/1992 | Stern et al. | 446/370 |
| 5,876,263 | A | 3/1999 | DeCesare et al. | |
| 6,142,851 | A | 11/2000 | Lewinski et al. | |
| 6,439,949 | B1 * | 8/2002 | Lucas et al. | 446/158 |
| 6,458,011 | B1 * | 10/2002 | Inoue et al. | 446/376 |
| 6,620,024 | B2 | 9/2003 | Choi | |
| 6,661,239 | B1 | 12/2003 | Ozick | |
| 6,672,934 | B2 | 1/2004 | Hornsby et al. | |
| 6,843,703 | B1 * | 1/2005 | Iaconis et al. | 446/371 |
| 6,940,291 | B1 | 9/2005 | Ozick | |
| 7,062,356 | B2 | 6/2006 | Takamura et al. | |
| 7,066,782 | B1 | 6/2006 | Maddocks et al. | |
| 7,207,859 | B1 * | 4/2007 | Iaconis et al. | 446/330 |
| 7,364,489 | B1 * | 4/2008 | Iaconis et al. | 446/330 |
| 7,431,629 | B1 * | 10/2008 | Maddocks et al. | 446/376 |
| 7,507,139 | B1 * | 3/2009 | Maddocks et al. | 446/282 |
| 7,695,341 | B1 * | 4/2010 | Maddocks et al. | 446/330 |
| 7,901,265 | B1 * | 3/2011 | Cameron et al. | 446/330 |

* cited by examiner

TOY WITH PIVOTING PORTIONS CAPABLE OF ROLLING OVER AND METHODS THEREOF

BACKGROUND OF THE INVENTION

1. Field of the Invention

The present invention relates to toys and more particularly to a toy with pivoting portions employing a simple yet unique pivoting mechanism providing back and forth and side to side pivoting movements operable to wiggle, twist back and forth, and roll the toy over numerous times imitating a playing, cuddling and rolling over puppy or the like. The invention also relates to methods for pivoting portions of the toy by employing the pivoting mechanism of the present invention.

2. Background of the Invention

Many known toys with pivoting or rotating portions are designed to enable the toy to walk or crawl or to in some way project itself forward or backward. To this end, the pivoting actions of most known toys are directed toward locomotion. However, some know toys not directed at locomotion include rotating portions that rock back and forth in a wagging motion or pivoting portions which move one portion in order to direct the movement of another portion.

Toys pivoting for locomotion are known to incorporate a rotary mechanism pivotally mounted by a swinging link to a support casing and coupled to two swinging arms. Rotation of a square transmission shaft actuates two biased wheels with cam studs located on both sides of the rotary mechanism providing a wriggling and swinging movement for the toy and causing the swinging arms to swing and move forward through an extension arm of the rotary mechanism simulating a walking movement. Alternatively, a pivoting portion, such as a tail, is known to oscillate upon a stud secured to a body and actuated by the rotation of a cam member. The tail is oscillated sideways helping to facilitate propulsion of the toy forward. Additionally, an undulatory motion is provided to a toy having a flexible body of elongated shape with an internally located sinusoidally shaped flexible member that is rotated to slide the toy along a surface. Likewise, a rocker arm coupled to wires extending the length of a series of tail sections provides lateral movements of the tail sections propelling the toy through a liquid.

Other known toys simulate locomotive positions and are seen to incorporate movable limbs attached to a body through ball and socket joints with attached cushion-type means and include a rib member within the body engaging a rubber band member that interconnects front and rear torso portions and facilitate the positioning of the toy in different locomotive poses.

Additionally, the known toys with pivoting or rotating portions not directed at locomotion include a central shaft extending along the toys' longitudinal axis which is rotated in order to wag, rock, or direct the movement of a pivoting portion. Eccentrically mounted discs along the central shaft wag an end portion of a toy when the central shaft is rotated. Additionally, a first shaft extending through a first pivoting portion coupled with a sleeve and spring to a second shaft extending through a second pivoting portion operates to transfer a motion applied to the first shaft into a mirrored motion in the second shaft. Directing an upward movement in the first shaft, for example lifting a tail, produces an upward movement in the second shaft, for example lifting a head portion.

Significantly, known toys which include pivoting portions do not include a pivoting mechanism operable to wiggle, twist back and forth, and roll the toy over one or more times. It would be desirable to provide a toy incorporating a first linkage coupling a pivoting portion to a body portion at an angled pivot point and incorporating an angled surface at the pivoting portion providing back and forth and side to side pivoting movements of the pivoting portion to wiggle, twist back and forth and roll the toy over numerous times.

SUMMARY OF THE INVENTION

The present invention addresses shortcomings of the prior art to provide a toy which simply yet uniquely provides back and forth and side to side pivoting movements of a pivoting portion to wiggle, twist back and forth and roll the toy over numerous times. An angled surface at the pivoting portion and a first linkage coupling the pivoting portion to a body portion at an angled pivot point facilitates the back and forth and side to side pivoting movements.

In one embodiment of the invention, a toy with pivoting portions includes a body portion, a first pivoting portion, a first linkage coupling the body portion to the first pivoting portion at an angled pivot point offset from a vertical axis intersecting the point at which the body and the first pivoting portions are coupled, and an angled surface at the first pivoting portion. A gear mechanism coupled to the body portion is operable to pivot the first pivoting portion with respect to the body portion driving the pivoting action at the angled surface of the first pivoting portion providing back and forth and side to side pivoting movements.

In another embodiment of the invention, the first linkage includes a rotatable drive shaft mechanically engaging the gear mechanism with the rotatable shaft including a surface that interfaces with the angled surface of the first pivoting portion. In another embodiment the first linkage comprises a telescoping member pivotably coupled to the first pivoting portion to facilitate the pivoting movements of the first pivoting portion, and in yet another embodiment, the telescoping member couples to the first pivoting portion at two or more pivot points in cooperation to provide a loose connection to facilitate the side to side pivoting movements of the first pivoting portion.

In still another embodiment of the invention, the angled surface of the first pivoting portion is offset from a horizontal plane bisecting the first pivoting portion, and in another embodiment, two fin like protrusions projecting from the first pivoting portion along the horizontal plane are included for facilitating a roll over movement. In another embodiment a covering at least partially incorporating the body and first pivoting portions is included.

In yet still another embodiment of the invention, a second pivoting portion is coupled to the body portion at an end opposite the first pivoting portion, and a second angled surface is included at the second pivoting portion. In another embodiment of the invention, a second linkage couples the body to the second pivoting portion at an angled pivot point offset from a vertical axis intersecting the point at which the body and the second pivoting portions are coupled, and in another embodiment, the gear mechanism is operable to pivot the second pivoting portion with respect to the body portion driving a pivoting action at the second angled surface of the second pivoting portion providing back and forth and side to side pivoting movements.

In another embodiment, a toy includes a body portion, a first pivoting portion, a first linkage coupling the body portion to the first pivoting portion at an angled pivot point offset from a vertical axis intersecting the point at which the body and the first pivoting portions are coupled, a first angled surface at the first pivoting portion, a second pivoting portion, a second linkage coupling the body portion to the second pivoting portion opposite the first pivoting portion at an angled pivot point offset from a vertical axis intersecting the point at which the body and the second pivoting portions are coupled, and a second angled surface at the second pivoting portion. A gear mechanism is coupled to the body portion and operable to pivot the first and second pivoting portions with respect to the body portion driving the pivoting action of the first pivoting portion at the first angled surface and of the second pivoting portion at the second angled surface providing back and forth and side to side pivoting movements and roll over actions.

In another embodiment of the invention, the first and second linkages each comprise a rotatable drive shaft mechanically engaging the gear mechanism, the rotatable shafts further comprise a surface that interfaces with one of the first and second angled surfaces. In another embodiment, the first linkage comprises a first telescoping member pivotably coupled to the first pivoting portion to facilitate the pivoting movements of the first pivoting portion, and in another embodiment, the second linkage comprises a second telescoping member pivotably coupled to the second pivoting portion to facilitate the pivoting movements of the second pivoting portion. In yet another embodiment, the first and second telescoping members couple to the first and second pivoting portions, respectively, at two or more pivot points in cooperation to provide a loose connection to facilitate the side to side pivoting movements of the first and second pivoting portions.

In another embodiment of the invention, a method for pivoting a portion of a toy, includes the steps of providing a body portion, providing a first pivoting portion, providing a first linkage for coupling the body portion to the first pivoting portion at an angled pivot point offset from a vertical axis intersecting the point at which the body and the first pivoting portions are coupled, angling a surface at the first pivot point, coupling a gear mechanism to the body portion operable to pivot the first pivoting portion with respect to the body portion. Driving the pivoting action at the angled surface of the first pivoting portion provides back and forth and side to side pivoting movements.

In another embodiment, the first linkage further provides a rotatable drive shaft mechanically engaging the gear mechanism, the rotatable shaft further providing a surface that interfaces with the angled surface of the first pivoting portion, and in another embodiment the first linkage further provides a telescoping member pivotably coupled to the first pivoting portion to facilitate the pivoting movements of the first pivoting portion. In yet another embodiment, the telescoping member couples to the first pivoting portion at two or more pivot points in cooperation to provide a loose connection to facilitate the side to side pivoting movements of the first pivoting portion, and in another embodiment two fin like protrusions projecting from the first pivoting portion along a horizontal plane are provided for facilitating a roll over movement.

For the purpose of facilitating an understanding of the inventions, the accompanying drawings and description illustrate a preferred embodiment thereof, from which the inventions, structure, construction and operation, and many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

A toy 10, as seen in FIGS. 1A-1D, is generally shaped to look like a puppy including a head portion 12, a middle portion 13, and a rear portion 14. The toy 10, employs a simple yet unique pivoting mechanism for providing back and forth and side to side pivoting movements operable to wiggle, twist back and forth, and roll the toy over one or more times, as shown in sequential FIGS. 1A-1D. Head portion 12 and rear portion 14 can pivot with respect to middle portion 13, providing the back and forth and side to side pivoting movements of the head and rear portions which imitate a playing, cuddling and rolling over puppy or the like. Additionally, the toy 10 includes sensors to respond to input from a user encouraging interactive play. It is also contemplated that the toy of the present invention can include any number of alternative shapes and sizes including other animal, robot or alien type figures, real or imagined, as well as other combinations of geometric shapes, etc., in which it would be desirable to exhibit pivoting movements of one or more pivoting portions in order to wiggle, twist back and forth, and/or roll over.

Figure 1A:
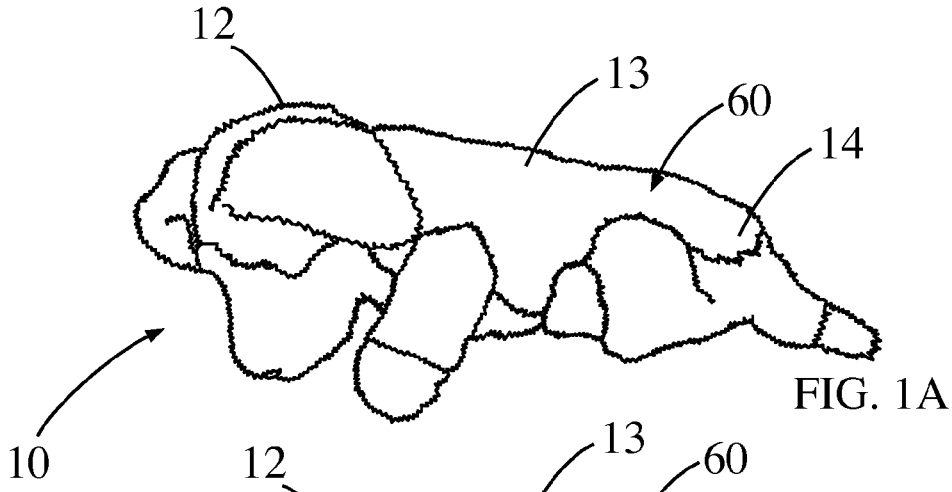
FIGS. 1A-1D are sequential perspective views of a toy of an embodiment of the present invention, with FIG. 1A illustrating a puppy laying face down on a surface, FIG. 1B illustrating the puppy positioned on it's side pivoting first and second portions to begin a rolling over action, FIG. 1C illustrating the puppy having rolled onto it's back with it's face up, and FIG. 1D illustrating the puppy on it's back but beginning to exhibit the pivoting of first and second pivoting portions to start the rolling over action again.
Figure 1B:
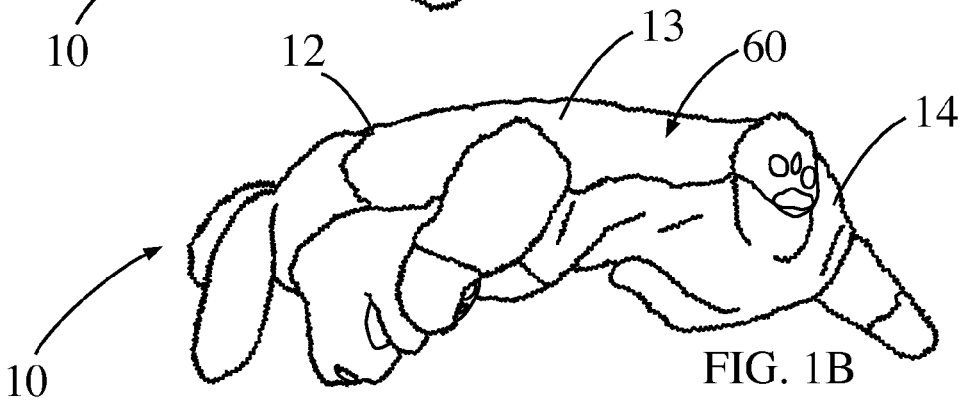
Figure 1C:
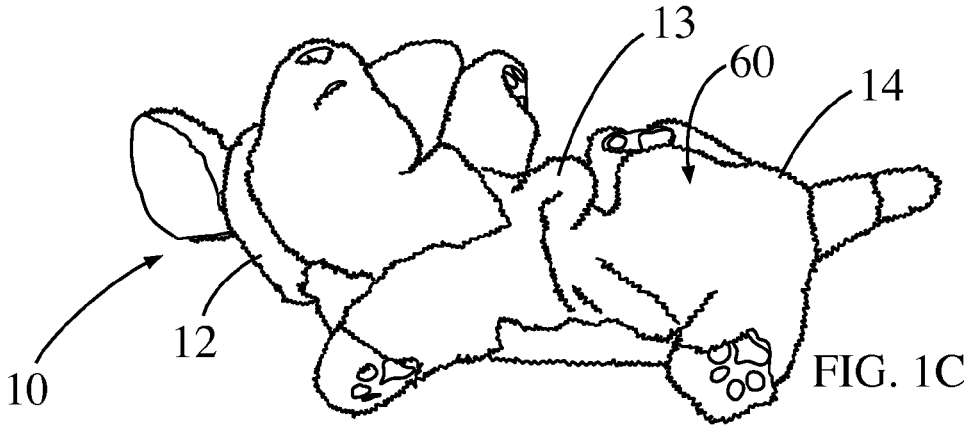
Figure 1D:
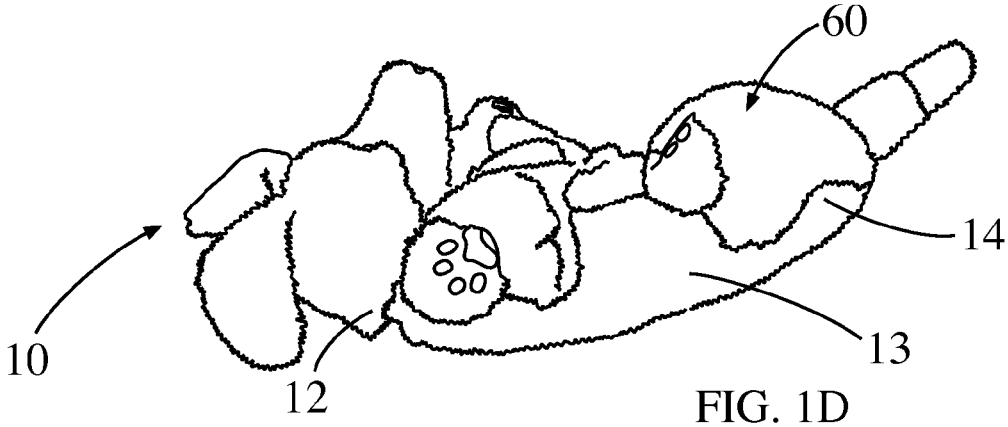
Figure 2:
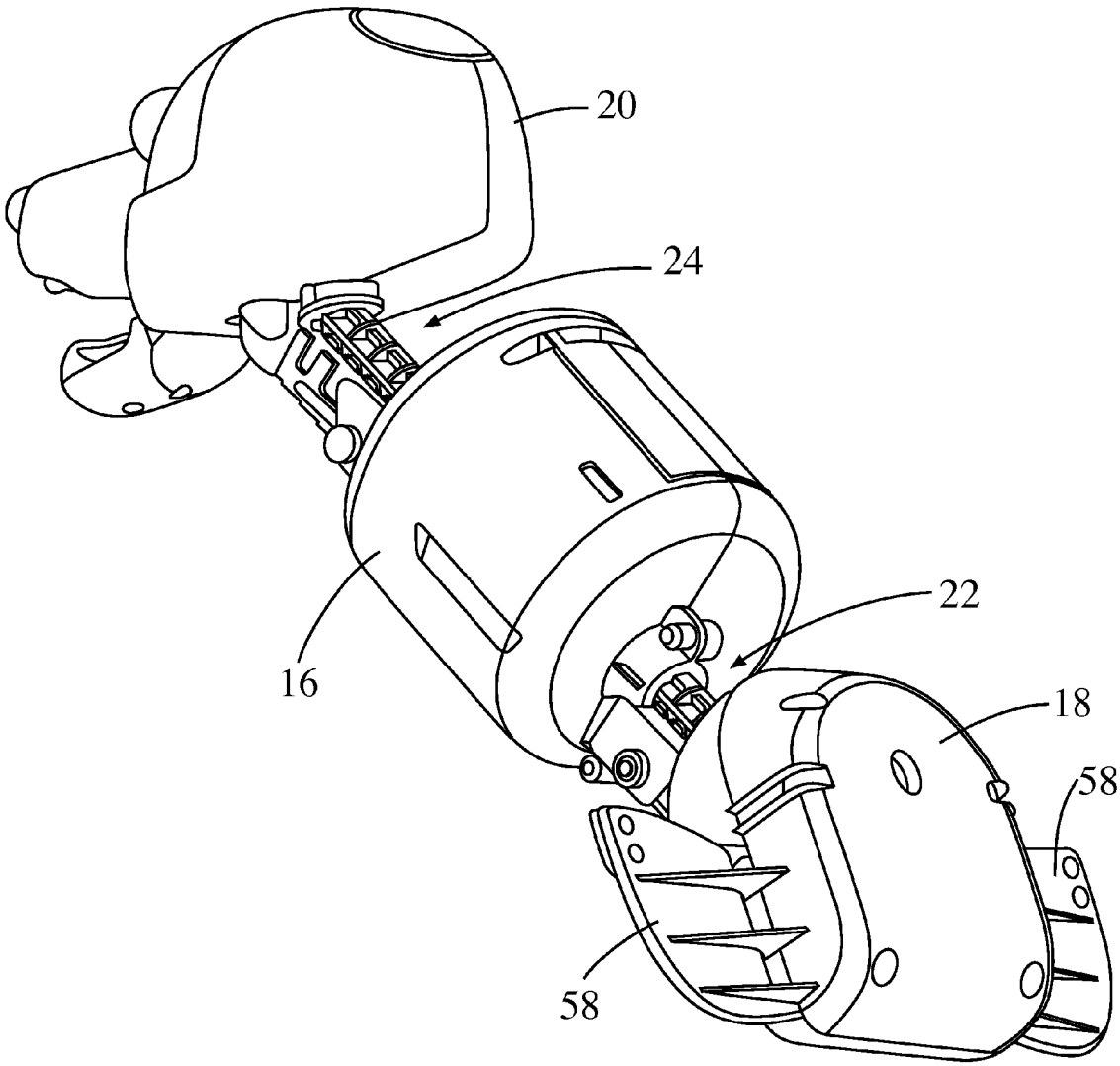
FIG. 2 is a perspective view of the toy of the present invention illustrating a body portion and a first and second pivoting portion.

The toy 10 includes a body portion 16 coupled to at least one of a first and second pivoting portion, 18 and 20, respectively. First and second pivoting portions 18 and 20, respectively, are coupled to body portion 16 at an end opposite each other, as seen in FIG. 2. A first linkage 22 couples the body portion 16 to the first pivoting portion 18, and a second linkage 24 couples the body portion 16 to the second pivoting portion 20. The body portion 16 is generally cylindrically shaped, as seen in FIG. 2, and houses a motor 26, as seen in FIG. 3, for driving the pivoting movements of the first and second pivoting portions, 18 and 20 respectively.

Figure 3:
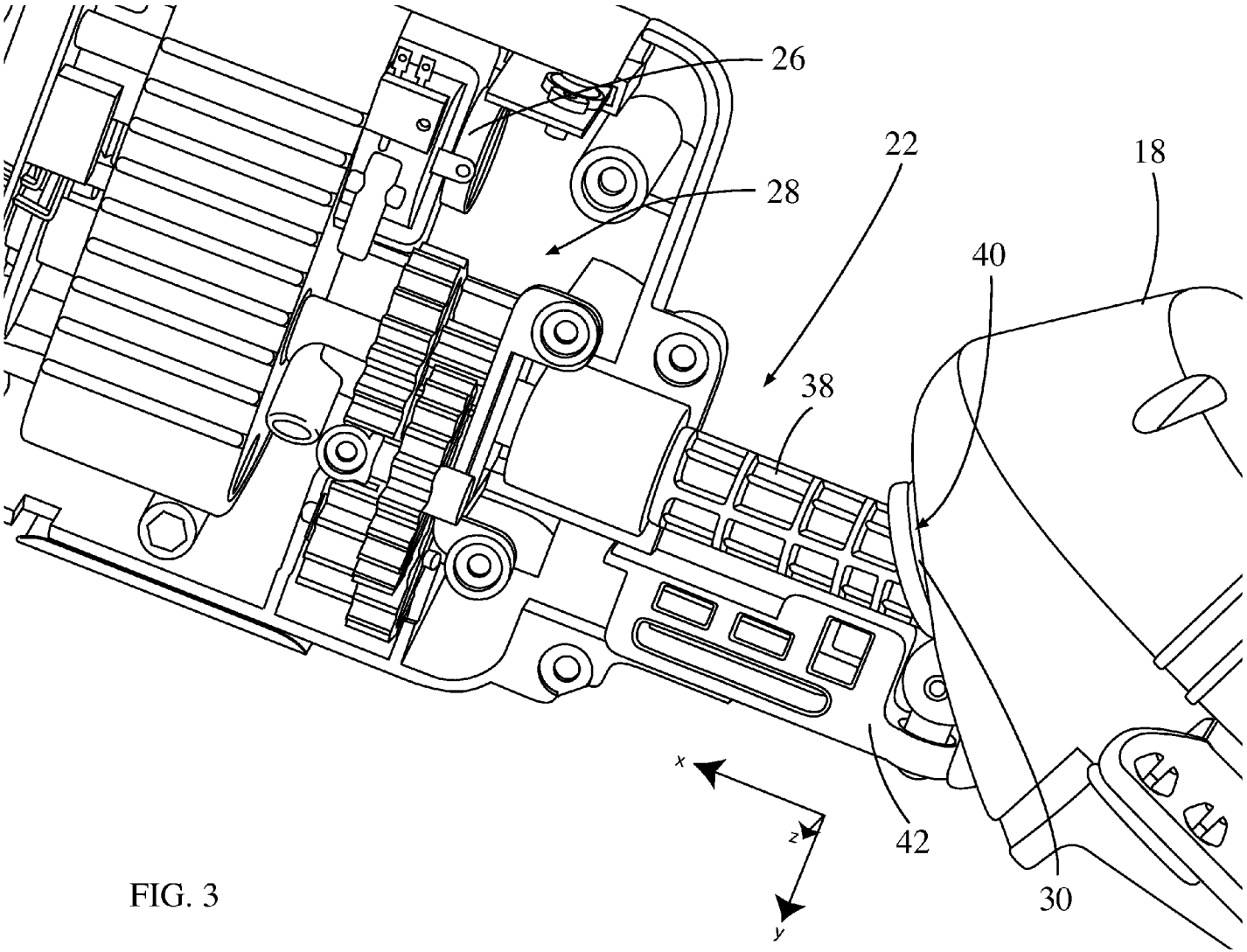
FIG. 3 illustrates a first linkage coupling the first pivoting portion to the body portion.

A gear mechanism 28 is coupled to the body portion 16, as seen in FIG. 3, and is operable to pivot the first and second pivoting portions with respect to the body portion. It is contemplated that the body portion 16 can include alternative shapes and sizes for coupling to pivoting portions and incorporating the motor 26 and gear mechanism 28, as well as for accommodating different toy shapes, as discussed above.

Figure 4:
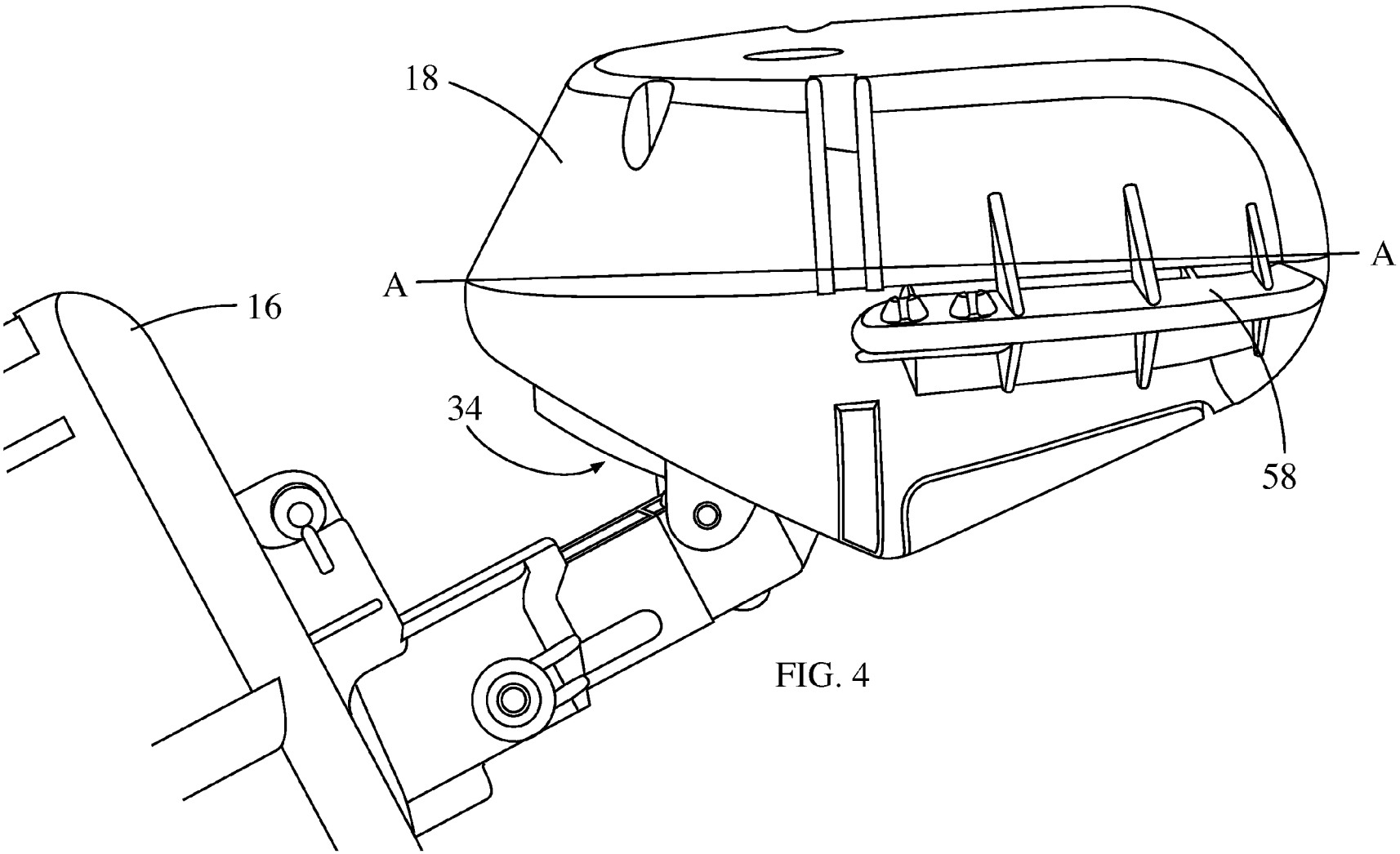
FIG. 4 illustrates an angled surface at the first pivoting portion.

The first linkage 22 couples the body portion 16 to the first pivoting portion 18 at an angled pivot point 30 offset from a vertical axis (shown as the Y axis) intersecting the point at which the body 16 and the first pivoting portion 18 are coupled, as seen in FIG. 3. Additionally, an angled surface 34, as seen in FIG. 4, is provided at the first pivoting portion 18 offset from a horizontal plane, line A-A as seen in FIG. 4, bisecting the first pivoting portion 18. The pivoting action is directed at the angled surface 34 providing for the back and forth and side to side pivoting movements of the first pivoting portion 18.

Figure 5:
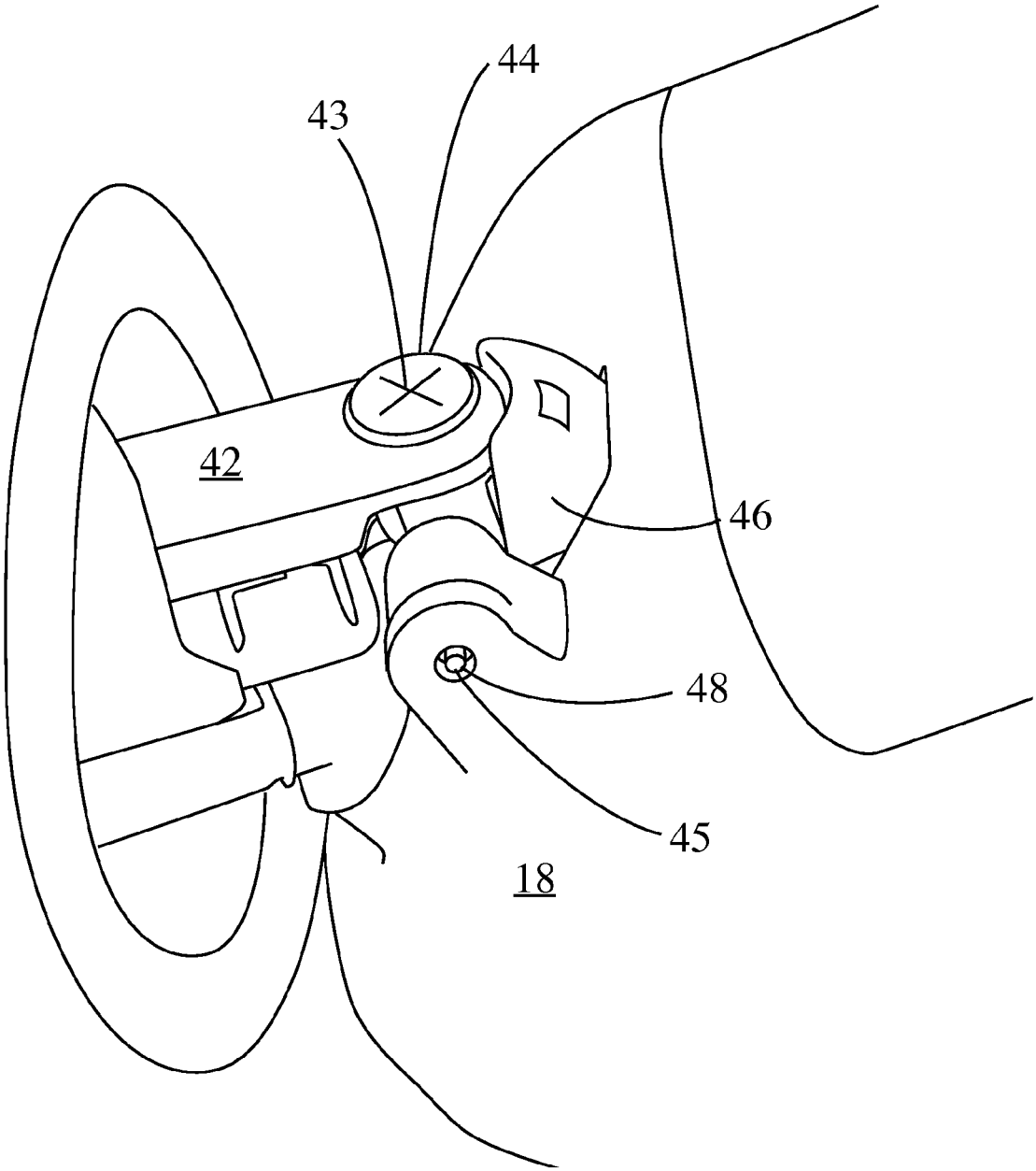
FIG. 5 a telescoping member coupled to the first pivoting portion at two pivoting points.

The first linkage 22 includes a rotatable drive shaft 38 mechanically engaging the gear mechanism 28, as seen in FIG. 3. The rotatable drive shaft 38 includes a surface 40 that interfaces with the angled surface 34 of the first pivoting portion 18 to drive the back and forth and side to side pivoting movements of the first pivoting portion 18. Additionally, the first linkage 22 includes a telescoping member 42 pivotably coupled to the first pivoting portion 18 to facilitate the pivoting movements of the first pivoting portion 18. The telescoping member 42 couples to the first pivoting portion at two or more pivot points, in cooperation. As seen in FIG. 5, pivot points 43 and 45 provide a loose connection capable of pivoting in at least two different directions to facilitate the back and forth and side to side pivoting movements of the first pivoting portion 18.

A screw 44 passes through an aperture in the telescoping member 42, as seen in FIG. 5, loosely coupling the telescoping member 42 to the pivoting portion 18 at pivot point 43 and facilitating the side to side pivoting movements of the first pivoting portion 18. Additionally, the screw 44 couples to a pivoting element 46 attached to the pivoting portion 18 at pin 48 and at the second pivot point 45 facilitating the back and forth pivoting movements of the first pivoting portion 18.

Figure 6:
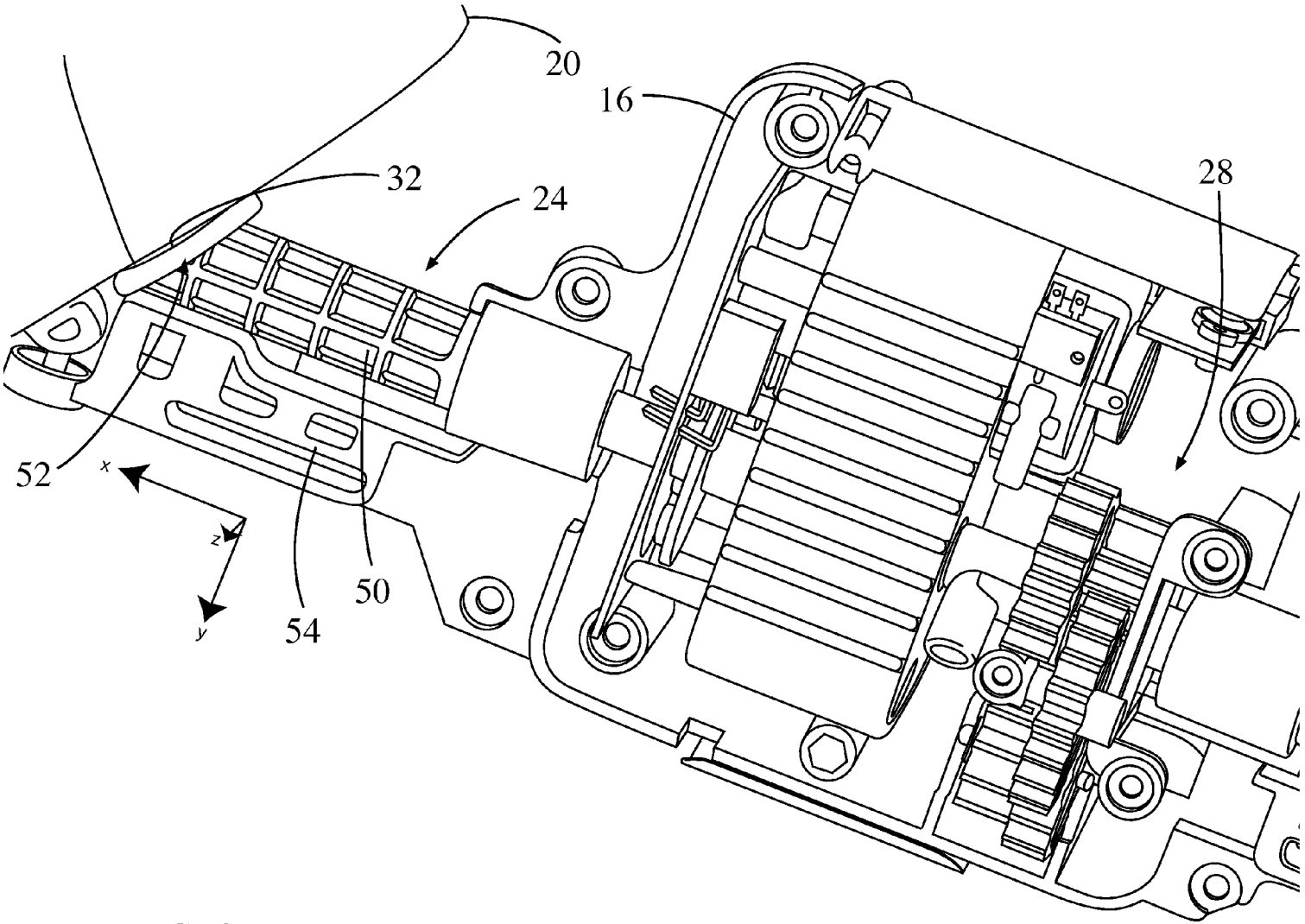
FIG. 6 illustrates a second linkage coupling the second pivoting portion to the body portion.
Figure 7:
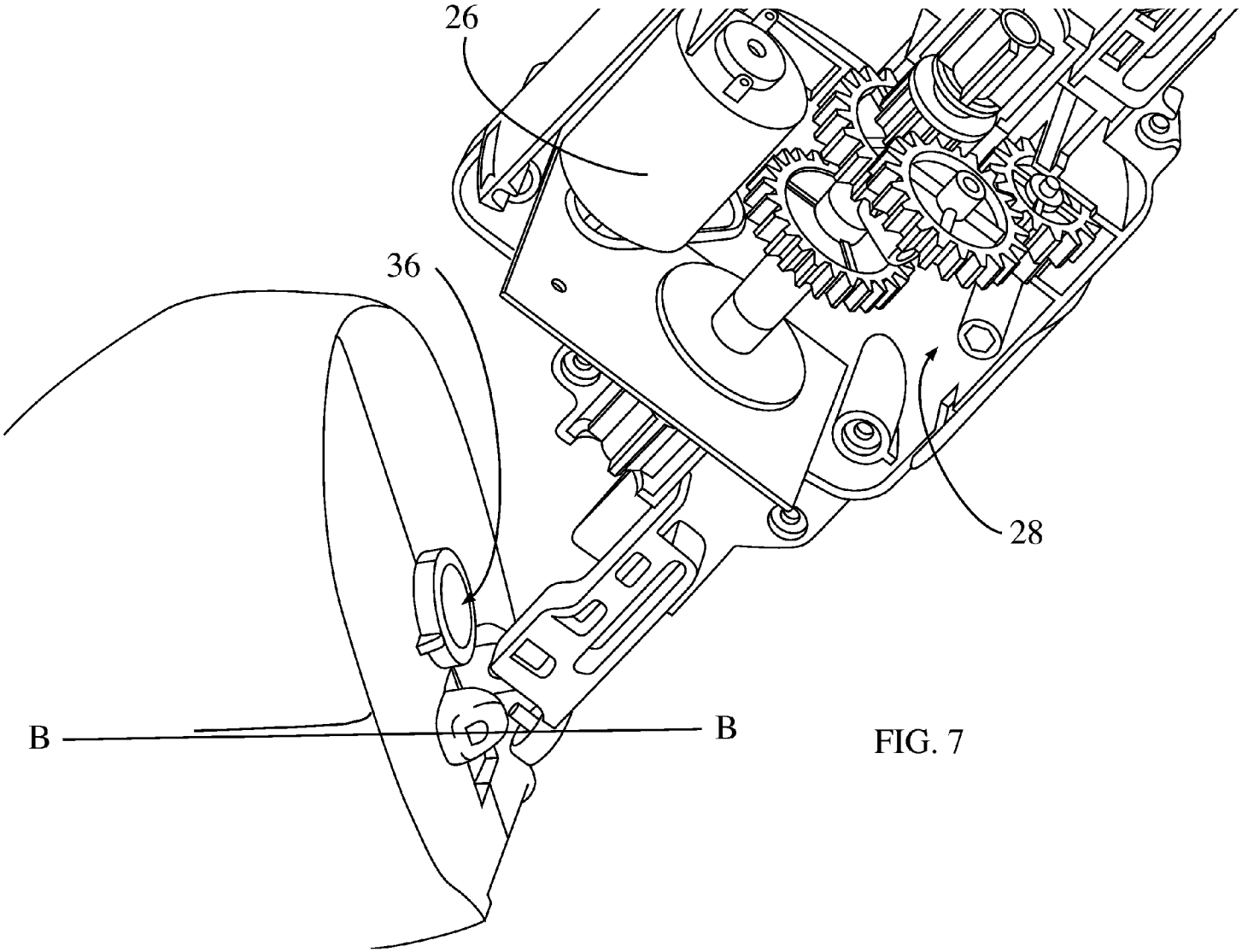
FIG. 7 illustrates a second angled surface at the second pivoting portion.

Likewise, the second linkage 24 couples the body portion 16 to the second pivoting portion 20 at an angled pivot point 32 offset from a vertical axis (shown as the Y axis) intersecting the point at which the body and the second pivoting portions are coupled, as seen in FIG. 6. A second angled surface 36, as seen in FIG. 7, is provided at the second pivoting portion 20 offset from a horizontal plane, line B-B, bisecting the second pivoting portion 20. The pivoting action is directed at the angled surface 36 to provide the back and forth and side to side pivoting movements of the second pivoting portion 20.

The second linkage 24 includes a rotatable drive shaft 50 mechanically engaging the gear mechanism 28, as seen in FIG. 6. The rotatable drive shaft 50 includes a surface 52 that interfaces with the angled surface 36 of the second pivoting portion 20 to drive the back and forth and side to side pivoting movements of the second pivoting portion 20. Additionally, the second linkage 24 includes a telescoping member 54 pivotably coupled to the second pivoting portion 20 to facilitate the pivoting movements of the second pivoting portion 20. The telescoping member 54 couples to the second pivoting portion 20 at two or more pivot points, in cooperation. Similar to the coupling between telescoping member 42 and first pivoting portion 18, as described above and seen in FIG. 5, two pivot points provide a loose connection between telescoping member 54 and second pivoting portion 20 and are capable of pivoting in at least two different directions to facilitate the back and forth and side to side pivoting movements of the second pivoting portion 20.

The gear mechanism 28, as seen in FIG. 7, is rotated by motor 26 and in turn rotates at least one of the rotatable drive shafts 38 and 50. The gear mechanism 28, as seen in FIGS. 3 and 6, is operable to pivot the first pivoting portion 18 with respect to the body portion 16, at the angled surface 34, and pivot the second pivoting portion 20 with respect to the body portion 16, at the second angled surface 36, providing back and forth and side to side pivoting movements of one or more of the pivoting portions 18 and 20.

To facilitate the roll over movement of toy 10, two fin like protrusions 58 project from the first pivoting portion 18, as seen in FIGS. 2 and 4, along a horizontal plane parallel with line A-A. As the first pivoting portion 18 is pivoted back and forth and side to side upon a surface, the protrusions 58 are operable to contact the surface and facilitate the roll over movement, as seen in FIGS. 1A-1D.

As is also seen in FIGS. 1A-1D, a covering 60 at least partially incorporates the body 16 and at least one of the first and second pivoting portions, 18 and 20 respectively. The covering 60 also facilitates the roll over movement of the toy 10 by providing some slipping resistance and/or gripping force preventing the first pivoting portion 18 from slipping on the surface during the roll over motion. The covering 60 can also resemble an animal's fur, as seen in FIGS. 1A-1D, which resembles puppy fur and generally enhances the overall aesthetics and cuddliness of the toy 10.

The covering 60 can also include puppy ears and feet, as well as other puppy markings to enhance the attractiveness and realism of the toy 10. It is also contemplated that the covering can include an alternative skin or sheathing including hair or other materials to provide an alternative overall look, commensurate with other animals, with or without fur, robot or alien type figures, real or imagined, as well as other combinations of geometric shapes, etc.

Figure 8:
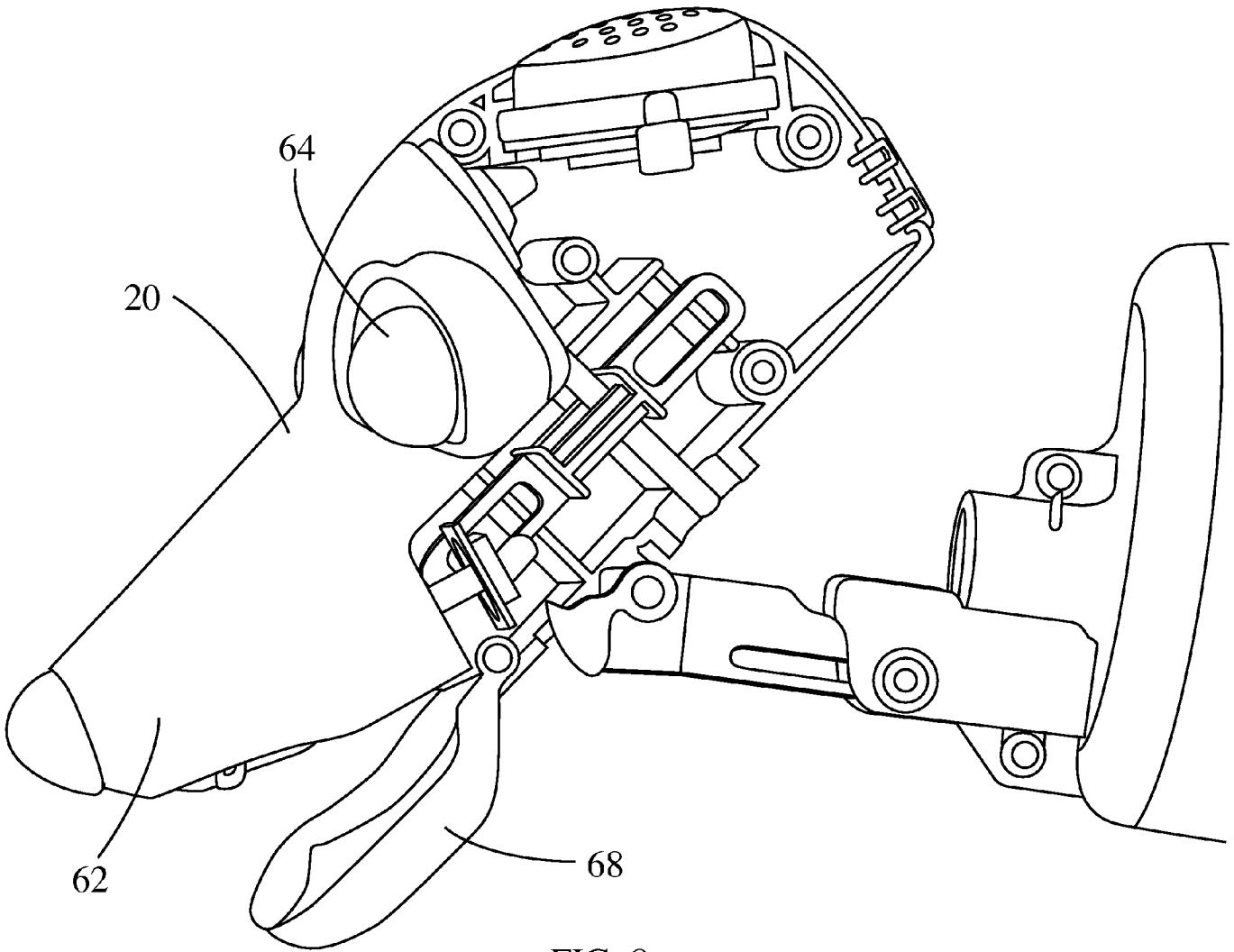
FIG. 8 illustrates the second pivoting portion and sensors contained therein.
Figure 9:
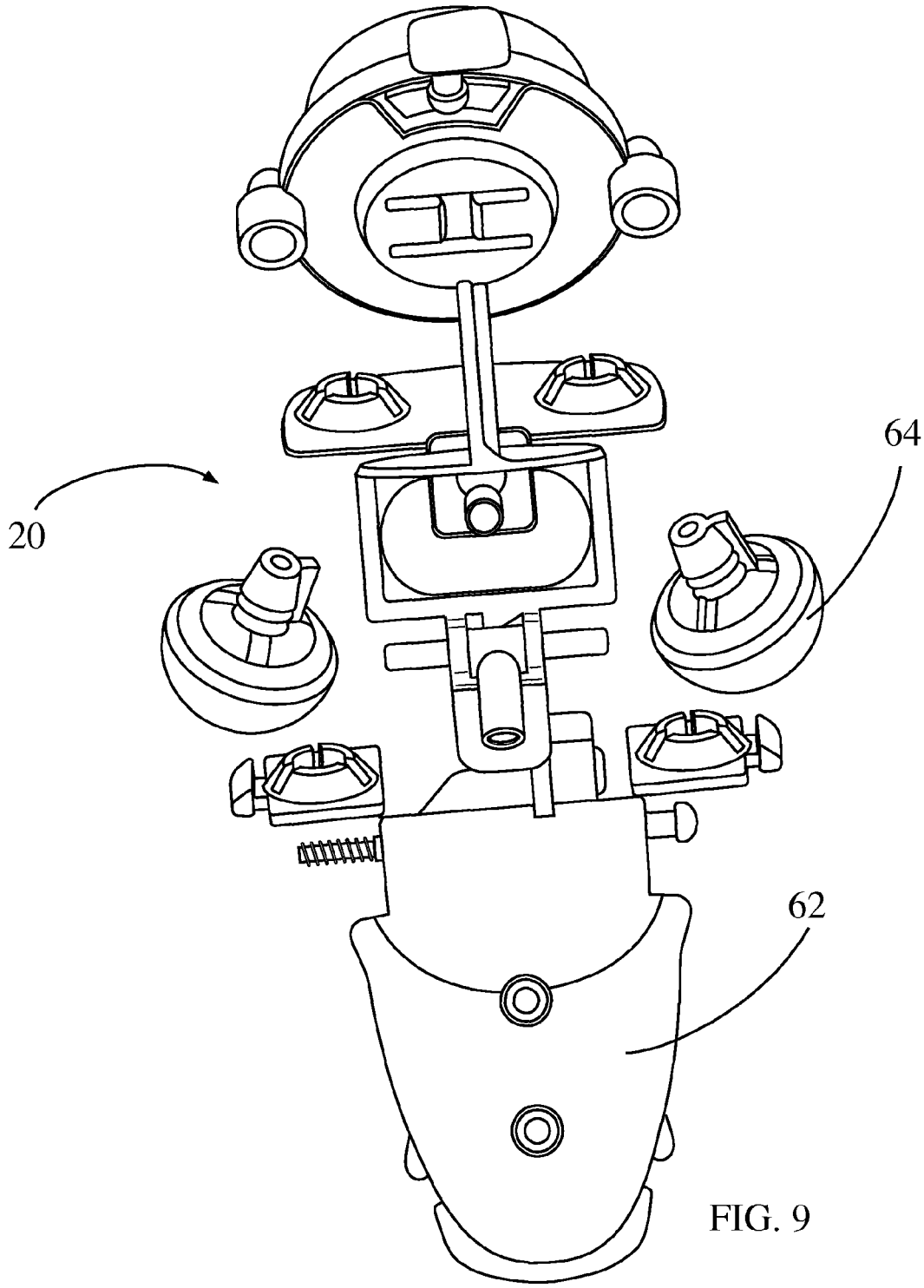
FIG. 9 is an exploded view of the second pivoting portion.

To further mimic the look and feel of a puppy or the like, the second pivoting portion 20, as seen in FIGS. 8 and 9, is shaped to resemble the head of a puppy including a snout 62, eyes 64, movable jaw 68, and one or more sensors 70 operable to facilitate interactive play with a user. Sensors 70 are positioned on top of the head of the second pivoting portion 20, as seen in FIG. 8, as well as in the body portion 16 (approximately at the back and belly of the toy) which actuate a control mechanism in the body portion 16 for manipulating the head 12 and/or rear 14 portions.

One or more of the sensors 70 may be touch-sensitive devices or switches. For example, one or more of the sensors 70 may be a pressure sensing device such as, for example, a pressure-activated switch in the form of a membrane switch. As another example, a sensor 70 may be made of a conductive material and may be an inductively-coupled device. In this case, when a user touches the toy 10 at the location of the inductive sensor, a measured inductance associated with the inductive sensor changes and the change is sensed. As a further example, a sensor 70 may be made of a conductive material and may be a capacitively-coupled device such that when a user touches the toy 10 at the location of the capacitive sensor, a measured capacitance associated with the sensor changes and the change is sensed. One or more of the sensors 70 may be a light-sensing device, such as, for example, an IR-sensing device or a photocell. Additionally or alternatively, one or more of the sensors 70 may be a sound-sensing device such as, for example, a microphone. The output device may be an optical device, such as, for example, a lamp or a light emitting diode, or an electromechanical device.

The toy 10 is operable to alternate between several play moods facilitated by the sensors which can be triggered by the user. For example:

Tickle Mode:

A tickle mode is initiated when the mid portion 13 (belly) is scratched. The puppy will giggle. If the puppy is on its belly, it will immediately turn over onto its back and begin twisting back and forth rapidly making giggly sounds. If the puppy is on is back, it will remain on its back and begin twisting back and forth rapidly making giggly sounds. As the puppy is continually tickled, the puppy's laughing will rise in intensity. If the puppy is tickled for 20 seconds, it will roll back onto its belly as if saying "that's enough," and try to catch its breath. If the puppy's belly is tickled again, it will roll back over onto its back and start over.

Petting Mode:

If the puppy's back or front left paw is scratched, it will make calm, happy noises and small, slow movements back and forth, but will not roll over. If the puppy is scratched 6 times, it will curl up and enter sleep mode.

Hangout Mode:

The puppy will enter hangout mode from any of the other modes if there is no switch input for 5 seconds. In hangout mode, the puppy will mostly do small movements and quiet sounds. After 60 seconds in hangout mode, the puppy will enter sleep mode.

Sleep Mode:

When the sleep mode is activated, the puppy will go into a full curled position and begin quietly snoring. Occasionally, the puppy will uncurl partly and make a little sleepy whimper.

A method for pivoting a portion of a toy includes the steps of providing a body portion, providing a first pivoting portion, and providing a first linkage for coupling the body portion to the first pivoting portion at an angled pivot point offset from a vertical axis intersecting the point at which the body and the first pivoting portions are coupled. Angling a surface at the first pivot point, coupling a gear mechanism to the body portion operable to pivot the first pivoting portion with respect to the body portion and driving the pivoting action at the angled surface of the first pivoting portion provides back and forth and side to side pivoting movements.

The first linkage further provides a rotatable drive shaft mechanically engaging the gear mechanism with the rotatable shaft further providing a surface that interfaces with the angled surface of the first pivoting portion. The first linkage also provides a telescoping member pivotably coupled to the first pivoting portion to facilitate the pivoting movements of the first pivoting portion. The telescoping member couples to the first pivoting portion at two or more pivot points, in cooperation, to provide a loose connection to facilitate the side to side pivoting movements of the first pivoting portion. Additionally, providing two fin like protrusions projecting from the first pivoting portion along the horizontal plane, line A-A, facilitates a roll over movement of the toy.

From the foregoing it can be seen that there has been provided a toy with pivoting portions activated by a simple yet unique pivoting mechanism providing back and forth and side to side pivoting movements operable to wiggle, twist back and forth and roll the toy over numerous times. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A toy, comprising:

a body portion;

a first pivoting portion;

a covering at least partially incorporating the body and first pivoting portions;

a first linkage coupling the body portion to the first pivoting portion at an angled pivot point offset from a vertical axis intersecting the point at which the first linkage and the first pivoting portions are coupled;

an angled surface at the first pivoting portion, wherein the angled surface of the first pivoting portion is offset from a horizontal plane bisecting the first pivoting portion;

two fin like protrusions projecting from the first pivoting portion along the horizontal plane for facilitating a roll over movement of the toy; and a gear mechanism coupled to the body portion and operable to pivot the first pivoting portion with respect to the body portion driving the pivoting action at the angled surface of the first pivoting portion providing back and forth and side to side pivoting movements.

2. The toy according to claim 1, wherein the first linkage comprises a rotatable drive shaft mechanically engaging the gear mechanism, the rotatable shaft further comprising a surface that interfaces with the angled surface of the first pivoting portion.

3. The toy according to claim 2, wherein the first linkage comprises a telescoping member pivotably coupled to the first pivoting portion to facilitate the pivoting movements of the first pivoting portion.

4. The toy according to claim 3, wherein the telescoping member couples to the first pivoting portion at two or more pivot points in cooperation to provide a loose connection to facilitate the side to side pivoting movements of the first pivoting portion.

5. The toy according to claim 1, further comprising a second pivoting portion coupled to the body portion at an end opposite the first pivoting portion, and a second angled surface at the second pivoting portion.

6. The toy according to claim 5, further comprising a second linkage coupling the body to the second pivoting portion at an angled pivot point offset from a vertical axis intersecting the point at which the second linkage and the second pivoting portions are coupled.

7. The toy according to claim 6, wherein the gear mechanism is operable to pivot the second pivoting portion with respect to the body portion driving a pivoting action at the second angled surface of the second pivoting portion providing back and forth and side to side pivoting movements.

8. A toy, comprising:

a body portion;

a first pivoting portion;

a first linkage having a rotatable drive shaft and a surface thereof coupling the body portion to the first pivoting portion at an angled pivot point;

a first angled surface at the first pivoting portion where the rotatable drive shaft of said first linkage interfaces with the first angled surface;

a second pivoting portion;

a second linkage having a rotatable drive shaft and a surface thereof coupling the body portion to the second pivoting portion opposite the first pivoting portion at an angled pivot point;

a second angled surface at the second pivoting portion where the rotatable drive shaft of said second linkage interfaces with the second angled surface; and a gear mechanism coupled to the body portion and mechanically engaging the rotatable drive shaft of said first linkage and the rotatable drive shaft of said second linkage to pivot the first and second pivoting portions with respect to the body portion driving the pivoting action of the first pivoting portion at the first angled surface and of the second pivoting portion at the second angled surface providing back and forth and side to side pivoting movements and roll over actions of the toy.

9. The toy according to claim 8, wherein the first linkage couples the body portion to the first pivoting portion at its angled pivot point offset from a vertical axis intersecting the point at which the first linkage and the first pivoting portions are coupled, and the second linkage couples the body portion to the second pivoting portion at its angled pivot point offset from a vertical axis intersecting the point at which the second linkage and the second pivoting portions are coupled.

10. The toy according to claim 9, wherein the first linkage comprises a first telescoping member pivotably coupled to the first pivoting portion to facilitate the pivoting movements of the first pivoting portion, and wherein the second linkage comprises a second telescoping member pivotably coupled to the second pivoting portion to facilitate the pivoting movements of the second pivoting portion.

11. The toy according to claim 10, wherein the first and second telescoping members couple to the first and second pivoting portions, respectively, at two or more pivot points in cooperation to provide a loose connection to facilitate the side to side pivoting movements of the first and second pivoting portions.

12. The toy according to claim 8, wherein the angled surface of the first pivoting portion is offset from a horizontal plane bisecting the first pivoting portion.

13. The toy according to claim 12, further comprising a covering at least partially incorporating the body and first pivoting portions.

* * * * *